US011678742B1

(12) United States Patent
Hogeback

(10) Patent No.: US 11,678,742 B1
(45) Date of Patent: Jun. 20, 2023

(54) ADJUSTABLE WINE RACK SYSTEM

(71) Applicant: Darryl Hogeback, Denver, CO (US)

(72) Inventor: Darryl Hogeback, Denver, CO (US)

( * ) Notice: Subject to any disclaimer, the term of this patent is extended or adjusted under 35 U.S.C. 154(b) by 0 days.

(21) Appl. No.: 17/739,462

(22) Filed: May 9, 2022

(51) Int. Cl.

| | |
|---|---|
| ***A47B 73/00*** | (2006.01) |
| ***A47F 7/28*** | (2006.01) |
| ***A47B 57/56*** | (2006.01) |
| ***A47B 57/04*** | (2006.01) |
| ***A47B 57/52*** | (2006.01) |

(52) U.S. Cl.
CPC ..... *A47B 73/006* (2013.01); *A47B 57/045* (2013.01); *A47B 57/52* (2013.01); *A47B 57/562* (2013.01); *A47F 7/28* (2013.01)

(58) Field of Classification Search
CPC ... A47F 7/28; A47F 5/08; A47F 5/103; A47B 73/006; A47B 73/00; A47B 73/008; A47B 47/022; A47B 57/42; A47B 57/46; A47B 57/52; A47B 96/061; A47B 57/04; A47B 57/562; A47B 96/14; A47B 57/045; A47B 57/06
USPC ..... 211/74, 75, 90.02, 103, 193; 248/242, 248/243
See application file for complete search history.

(56) References Cited

U.S. PATENT DOCUMENTS 3,089,675 A * 5/1963 Lozier ..... A47B 57/425 248/242
3,229,648 A * 1/1966 Hobson ..... A47B 57/52 108/159
3,572,626 A * 3/1971 Bertschi ..... A47B 57/045 248/242
3,700,114 A * 10/1972 Myers ..... A47F 5/12 248/242
3,921,539 A * 11/1975 Berger ..... A47F 5/12 108/106
4,444,323 A * 4/1984 Travis ..... A47B 57/52 211/208
4,648,516 A * 3/1987 Elkins ..... A47B 81/005 224/482
D294,221 S * 2/1988 Sheftel ..... 248/242
4,836,484 A * 6/1989 Reed ..... A47B 57/52 108/107
5,154,385 A * 10/1992 Lindberg ..... A47B 57/562 248/245
5,169,009 A * 12/1992 Bomze ..... A47B 73/00 211/74
5,185,971 A * 2/1993 Johnson, Jr. ..... A47F 5/0846 52/36.6

(Continued)

*Primary Examiner* — Jennifer E. Novosad
(74) *Attorney, Agent, or Firm* — Russell Manning; FisherBroyles LLP

(57) ABSTRACT

A wine rack system having a standard with first and second elongated strips disposed in a substantially parallel and spaced relationship. At least first and second pins extend between the first and second elongated strips. Adjacent pairs of pins are spaced a first distance apart. A support arm is configured to attach to an adjacent pair of the pins. A connecting end of the support arm is sized for receipt between the spaced elongated strips. The connecting end includes an upper recess formed in an upper edge and a lower recess formed in a lower edge. Bottom ends of the recesses are spaced a second distance apart that is less than a distance between the pair of adjacent pins allowing for engagement of the pins within the recesses. A bottle holder configured to support a wine bottle is attached to the support arm.

14 Claims, 12 Drawing Sheets

(56) References Cited

U.S. PATENT DOCUMENTS 5,592,886 A * 1/1997 Williams ..... A47B 57/52 248/250
5,695,163 A * 12/1997 Tayar ..... A47B 96/061 248/250
5,816,419 A * 10/1998 Lamson ..... A47B 57/045 248/242
6,591,996 B1 * 7/2003 Wu ..... A47B 96/067 211/187
6,641,098 B1 * 11/2003 Proffitt ..... A47B 57/42 248/242
7,246,711 B1 * 7/2007 Metcalf ..... A47B 57/16 211/90.03
7,350,649 B1 * 4/2008 Martens ..... A47B 57/06 211/187
7,509,702 B2 * 3/2009 Cantis ..... E04G 3/26 256/65.01
7,611,111 B2 * 11/2009 Costa ..... A47F 5/0081 211/103
7,878,340 B1 * 2/2011 Olsen ..... A47B 73/00 211/186
7,882,967 B2 * 2/2011 Hynes ..... A47B 73/00 211/75
8,042,892 B2 * 10/2011 Benz ..... F25D 25/02 108/108
8,276,769 B2 * 10/2012 Hogeback ..... A47F 7/28 211/74
8,596,590 B2 * 12/2013 McCoy ..... F16M 13/02 248/68.1
8,757,743 B2 * 6/2014 Wilson ..... F25D 25/04 108/108
8,978,901 B2 * 3/2015 Hogeback ..... A47F 7/283 211/74
9,642,456 B2 * 5/2017 Cooper ..... A47B 57/10
11,297,944 B2 * 4/2022 Deckebach ..... A47B 73/00
2005/0204966 A1 * 9/2005 Bienick ..... A47B 57/48 248/220.21
2008/0197253 A1 * 8/2008 Thompson ..... A47B 96/1416 52/36.5
2011/0132853 A1 * 6/2011 Drobot ..... A47F 5/0853 211/183
2012/0085721 A1 * 4/2012 Michael J. ..... A47F 5/0853 211/103
2021/0112974 A1 * 4/2021 Appelo ..... A47B 43/00

* cited by examiner

ADJUSTABLE WINE RACK SYSTEM

FIELD

Embodiments of the present disclosure relate to wine racks, and more particularly to an adjustable wine rack system suitable for storing and displaying wine bottles horizontally.

BACKGROUND

Conventionally, wine racks are used in wine cellars or other wine storage areas to store numerous bottles of wine. In such conventional wine racks, the bottles of wine are typically supported along the length of the bottle within a grid of cavities stacked upon and next to each other, each cavity typically formed by pairs of parallel wood supports held in position by front and rear frame structures. Such conventional wine racks are typically configured such that bottles of wine are disposed longitudinally within a rectangular cavity. In such an arrangement, only the top ends (i.e., where the foil is wrapped around the top end) of the wine bottles are visible when viewing the wine rack. In contrast, the labels on the wine bottle are not generally visible by the user. However, many wine collectors and retailors desire to more fully display wine bottle labels.

It is, against this background those various embodiments of the present disclosure were developed.

SUMMARY

In light of the above and according to one aspect of the disclosure is a wine racking system that allows for displaying wine bottles and their labels while deemphasizing the wine rack.

In an embodiment, a wine rack system is provided having a standard with first and second elongated strips disposed in a substantially parallel and spaced relationship. At least first and second pins extend between the first and second elongated strips. Adjacent pairs of pins are spaced a first distance apart. A support arm is configured to attach to an adjacent pair of the pins. A connecting end of the support arm is sized for receipt between the spaced elongated strips. The connecting end includes an upper recess formed in an upper edge and a lower recess formed in a lower edge. The recesses are sized to receive the pins. Bottom ends of the recesses are spaced a second distance apart that is less than a distance between the pair of adjacent pins. This allows for engaging the pins within the recesses. A bottle holder configured to support a wine bottle is attached to the support arm.

Other embodiments are disclosed herein. The foregoing and other features, utilities and advantages of various embodiments of the inventions will be apparent from the following more particular description of the various embodiments of the invention as illustrated in the accompanying drawings and claims.

DETAILED DESCRIPTION

Reference will now be made to the accompanying drawings, which assist in illustrating the various pertinent features of an adjustable wine rack system. The following description of the adjustable wine rack system is presented for purposes of illustration and description. Furthermore, the description is not intended to limit the racking system to the form disclosed herein. Consequently, variations and modifications commensurate with the following teachings, and skill and knowledge of the relevant art, are within the scope of the present disclosure.

The present application recognizes that for many wine enthusiasts, the display of individual wine bottles is of importance. For instance, wine collectors often spend considerable sums of money on wine collections. Accordingly, storage systems for wine are of considerable importance to such collectors and should share a number of important features. For instance, it is desirable that wine bottles be stored in a generally horizontal position such that bottle corks remain in contact with wine in the bottles. It is also desirable that the wine bottles be spaced to permit airflow between individual bottles. In addition, it may be desirable for a wine rack system to allow for viewing of individual labels without having to remove a wine bottle from the wine rack. Further, it may be desirable to maintain the integrity of labels on the wine bottles. Finally, it may be desirable to emphasize the wine bottles while deemphasizing the wine rake. Accordingly, the disclosed wine rack systems herein allow for holding multiple wine bottles in a generally horizontal configuration, permitting airflow between individual bottles and allowing display of labels of individual bottles.

Figure 1A:
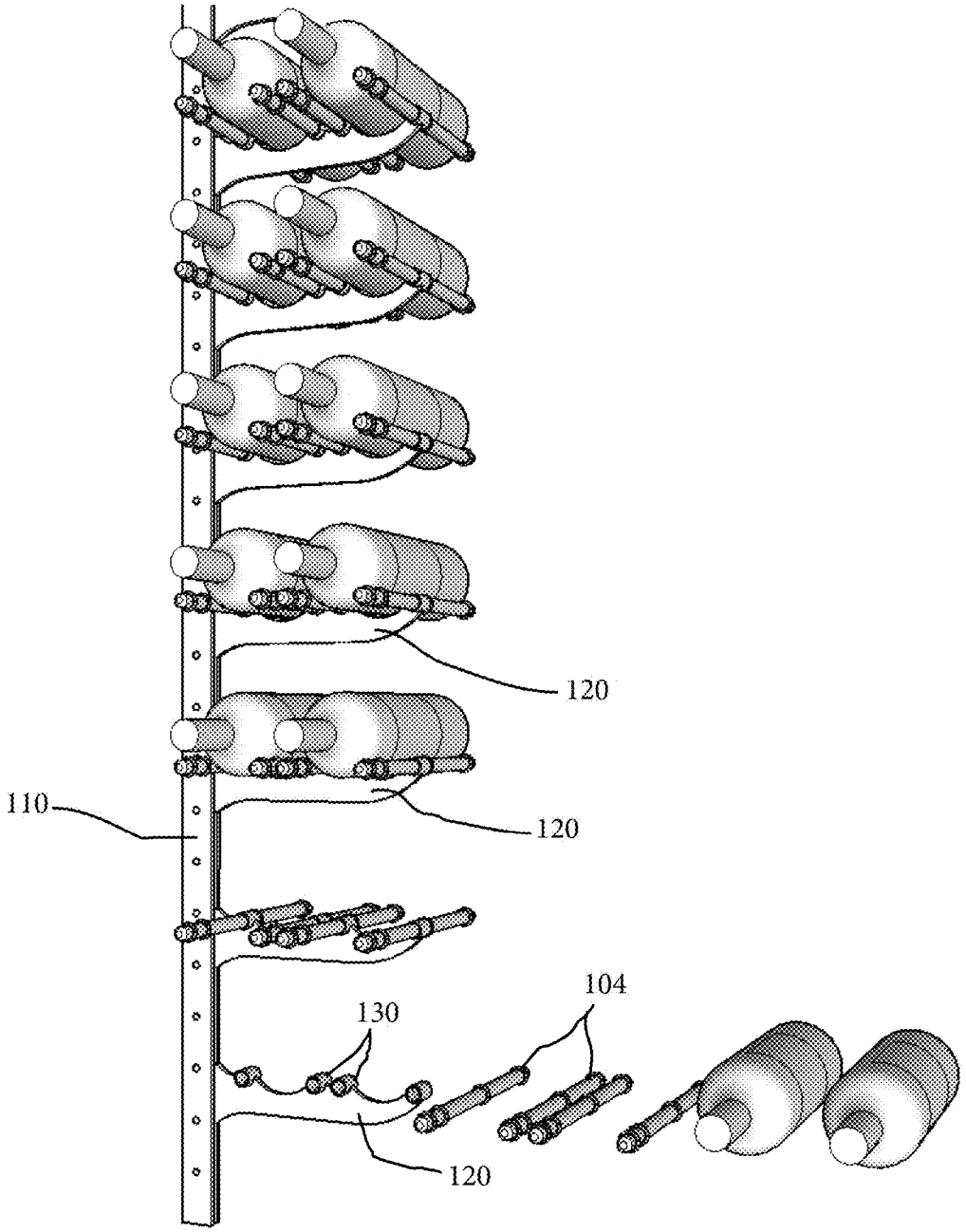
FIG. 1A illustrates an embodiment of a wine rack system in first configuration.
Figure 1B:
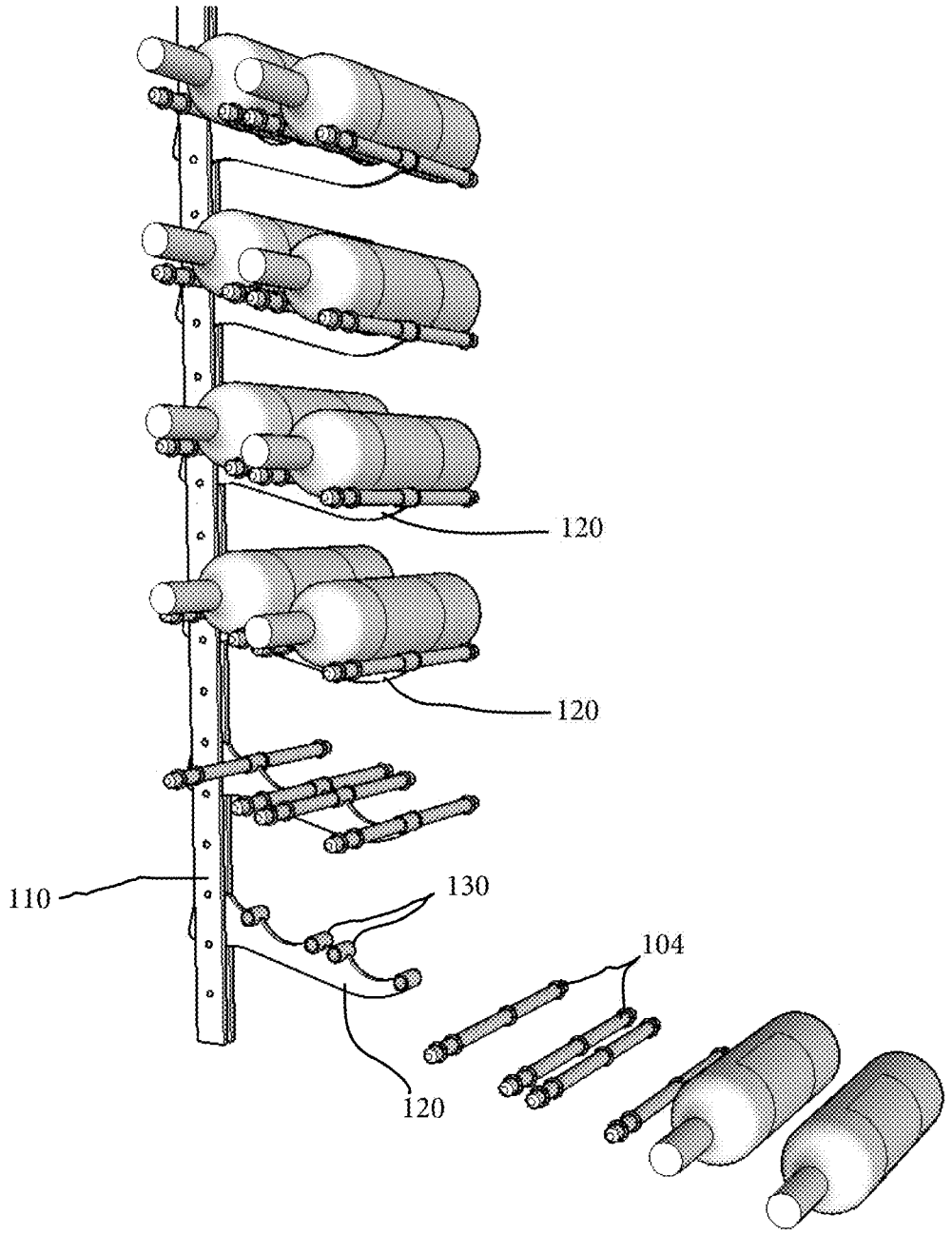
FIG. 1B illustrates an embodiment of a wine rack system in second configuration.

FIGS. 1A and 1B illustrates a first embodiment of an adjustable wine racking system in accordance with the present disclosure. As illustrated, the wine rack system 100 includes an upright support or 'standard' 110 to which one or more bottle holder brackets 120 may be selectively attached at various vertical positions. In the illustrated embodiment, the bottle holder brackets 120 are attached to the standard 110 in evenly spaced increments. However, it will be noted that the spacing of the bottle holders 120 may be varied along the height of the standard 110. As illustrated, the bottle holder brackets 120 may be attached to the standard 110 such that a body or cantilevered support arm of each bottle holder bracket 120 is substantially horizontal (e.g., generally perpendicular) the vertical standard 110 (See FIG. 1A) or such that the support arm is tilted at an angle relative to the vertical standard (See FIG. 1B). In an embodiment, each bottle holder bracket 120 is configured to hold two wine bottles such that a long axis of each bottle is substantially perpendicular to the cantilevered support arm/body when attached to the vertical standard. If held in a horizontal position (e.g., See FIG. 1A), a label of an inner wine bottle may not be visible. However, by tilting the bottle holder bracket relative to the standard, labels of both bottles may be displayed. See, e.g., FIG. 1B.

Figure 2A:
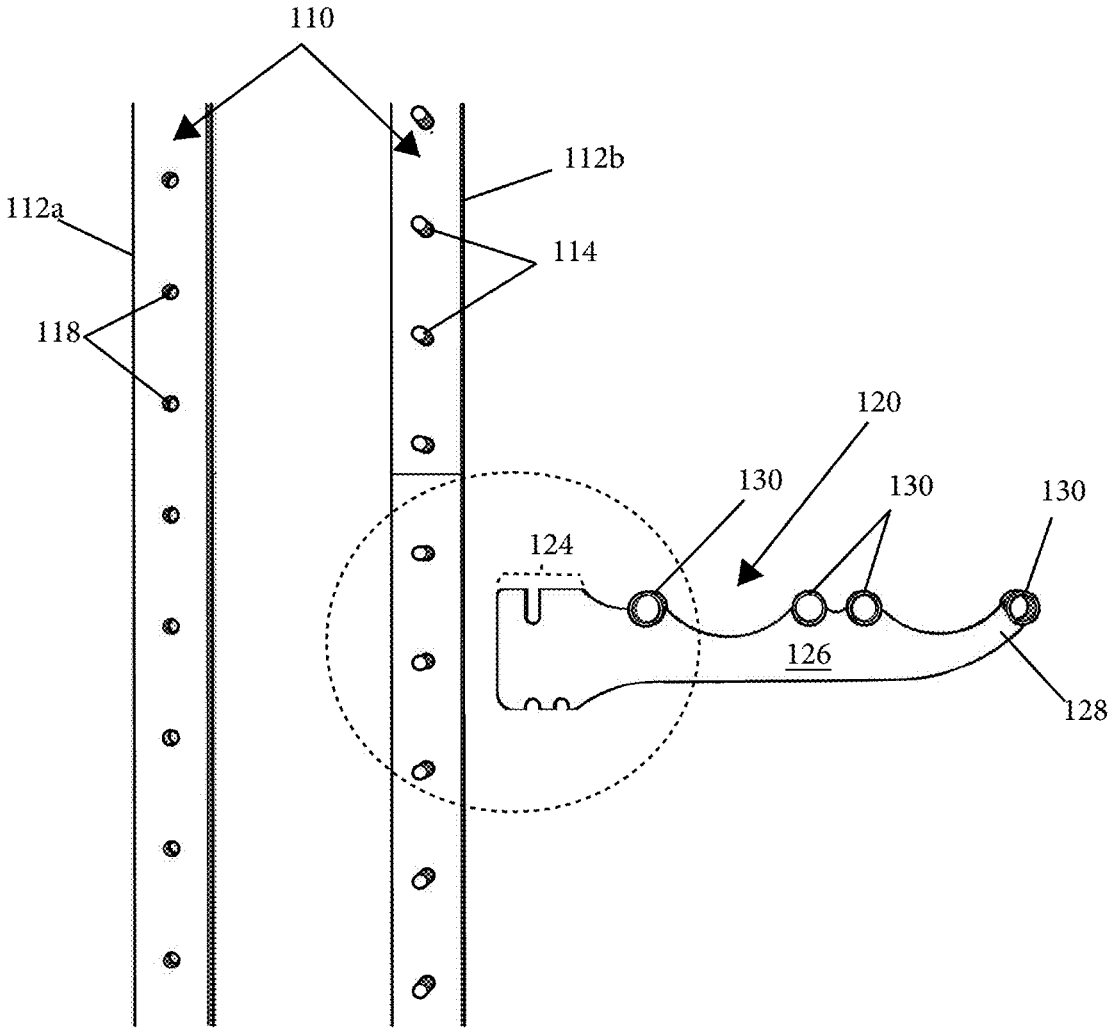
FIG. 2A illustrates a standard and a support arm in an embodiment.
Figure 2B:
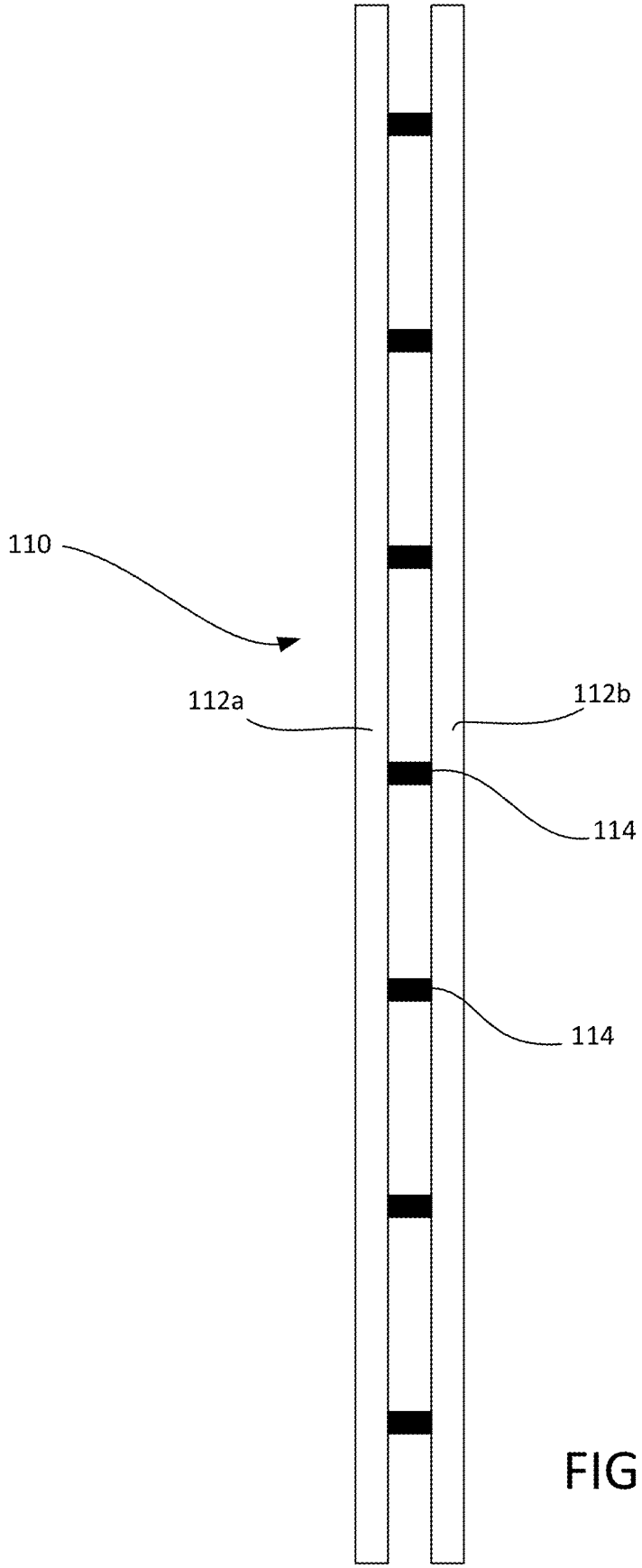
FIG. 2B illustrates a standard in an embodiment.

FIGS. 2A and 2B illustrate a side exploded view and an end view of the standard 110, respectively. As shown, the standard is formed from first and second elongated strips 112*a*, 112*b* (hereafter 112 unless specifically referenced) disposed in a parallel and spaced relationship. The elongated strips 112 may be formed from plate metal (e.g., quarter-inch plate metal strips). However, the strips 112 may be formed of other materials including, without limitation woods, polymers, composites etc. A plurality of studs or pins 114 extend between the inside surfaces of the two spaced elongated strips 112. In an embodiment, the pins 114 are metallic pins that are inserted through apertures 118 formed (e.g., drilled) in the elongated strips 112. Once positioned within the strips the metallic pins may be welded or otherwise secured to the strips 112. In other embodiments, different materials may be utilized to form the pins.

The plurality of pins 114 disposed along the length of the standard 110 are utilized to selectively connect one or more bottle holder brackets 120 to the standard 110. More specifically, each bottle holder bracket 120 engages an adjacent pair of pins to secure the bottle holder to the standard, as more fully discussed below. In the illustrated embodiment, the pins 114 are evenly spaced along the length of the standard 110. In this regard, a bottle holder bracket may engage any two adjacent pins. However, it will be appreciated in other embodiments adjacent pairs of pins 114 may have different spacing so long the adjacent pairs of pins allow for engaging a bottle holder bracket.

As illustrated in the embodiment of FIG. 2A, the bottle holder bracket 120 extends from a connecting end 124 to a free or cantilevered end 128. In this embodiment, a body of the bracket forms a cantilevered support arm 126 that may support one or more wine bottles, when the bracket 120 is connected to the standard 110. In the illustrated embodiment, the bracket 120 includes four hollow ferrules 130 for receiving rods 104 or dowels (See also FIG. 1A). When such rods are inserted within the ferrules 130, the four supported rods 104 define two bottle holders that may hold two bottles of wine substantially transverse to a long axis of the support arm between its connection end and its free end. Though shown as utilizing ferrules to receive bottle supporting rods, it will be appreciated that other bottle supports may be attached to the support arm.

In the illustrated embodiment, the support arm 126 is formed from a sheet material (e.g., metal). In such an embodiment, the support arm may include a common width over its length from the connection end 124 to the cantilevered end 128. In any embodiment, a width of the connecting end 124 is narrower/thinner than a spacing between the first and second elongated strips 112*a*, 112*b*. This allows inserting the connecting end 124 between the strips 112*a*, 112*b* such that the bracket may engage a pair of pins extending between the strips. Once engaged with a pair of pins, the bracket is securely fastened to the standard.

Figure 2C:
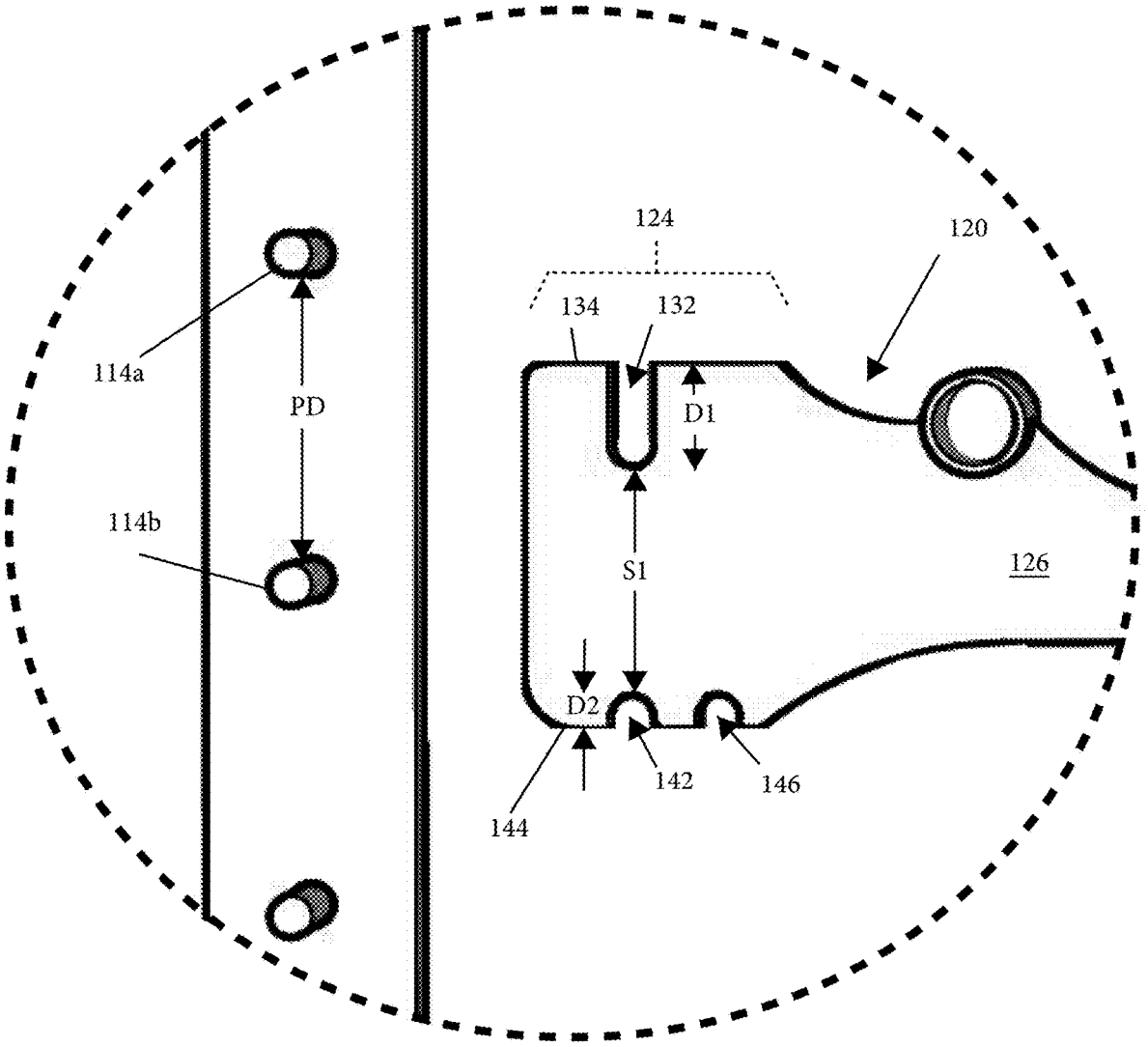
FIG. 2C illustrates a partial close up of FIG. 2A.

The connection end 124 of the bracket 120 utilizes opposing recesses to engage a pair of adjacent pins of the standard. This is best illustrated in FIG. 2C. As illustrated, the connection end 124 includes an upper recess 132 formed in an upper edge 134 of the support arm 126. The connection end 124 also includes at least a first lower recess 142 formed in a lower edge 144 of the support arm 126. Each of the recesses extends into the body/support arm 126. However, a depth D1 of the upper recess 132 (e.g., distance between an open end of the recess at the upper edge 134 and a closed bottom end of the recess) is greater than a depth D2 of the lower recess 142 (e.g., distance between an open end of the recess at the lower edge 144 and a closed bottom end of the recess). Further, a spacing S1 between the closed bottom ends of the upper recess 132 and the lower recess 142 is less than a pin spacing distance PD between adjacent pins 114*a*, 114*b* of the standard.

The increased depth D1 of the upper recess 132 in conjunction with the spacing S1 between the closed bottom ends of the recesses 132, 142 being less than the pin spacing PD between the pins 114*a*, 114*b* (hereafter 114 unless specifically referenced) allows engaging the engaging the bracket 120 with the pins 114 extending between the upright strips 112 of the standard 110. FIGS. 3A-3D illustrate a side-view of a process for engaging the bracket 120 with the pins 114 of the standard 110. As illustrated, one of the upright strips is removed for purposes of illustration. Initially, the connection end 124 (see also FIG. 2C) of the bracket 120 is initially inserted between the upright strips 112. See FIG. 3A. The bracket 120 is rotated counterclockwise (as illustrated) to align the upper recess 132 with an upper pin 114*a* of a pair of adjacent pins 114*a*, 114*b*. Once aligned, the bracket is moved upward until the upper pin 114*a* is disposed at or near the closed bottom end of the upper recess 132. See FIG. 3B. The bracket 120 may then rotate clockwise (as illustrated) such that the lower edge 144 of the bracket 120 passes over the lower pin 114*b*. See FIG. 3C. Such rotation may continue until the lower recess 142 is aligned with the lower pin 114*b*. Once aligned, the bracket 120 may be lowered until the lower pin 114*b* engages the closed bottom end of the lower recess 142. See FIG. 3D. At this time, the bracket 120 is supported by the lower pin 114*b* while the upper pin 114*a* remains within the upper recess 132. Once engaged with the pins 114*a*, 114*b*, the support arm cantilevers from the standard and one or more wine bottles may be supported by the bracket 120. See, e.g., FIG. 1A.

Figure 3A:
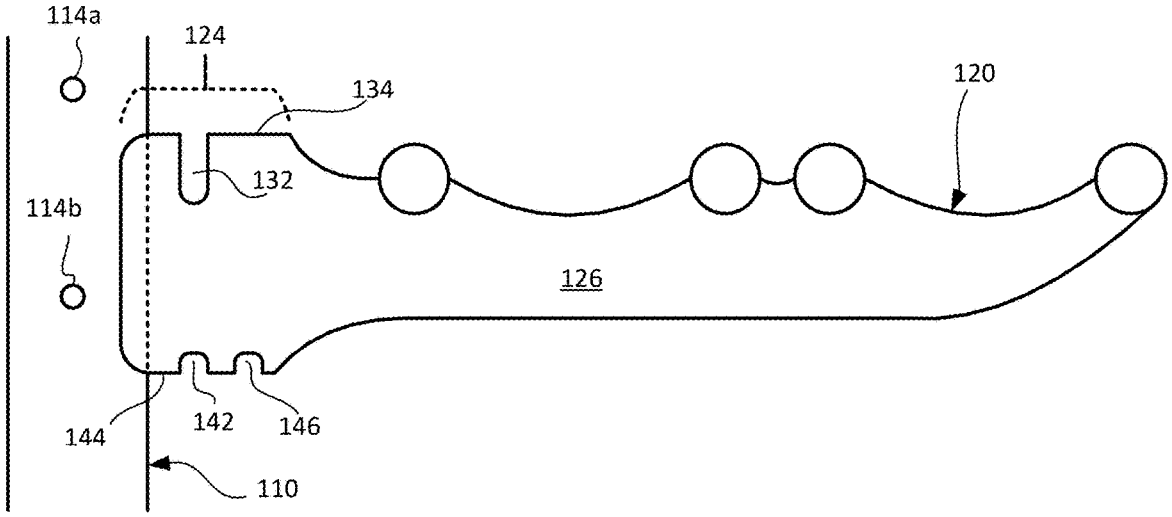
FIGS. 3A-3D illustrate a process of attaching a support arm to a standard in a first configuration.
Figure 3B:
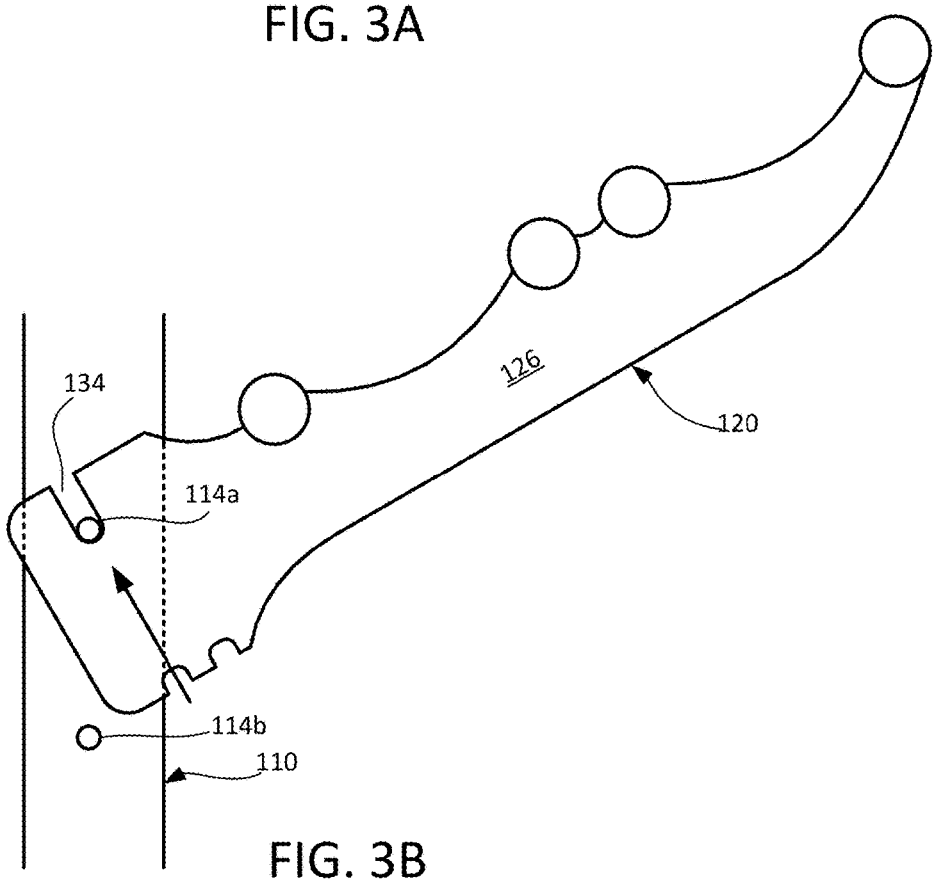
Figure 3C:
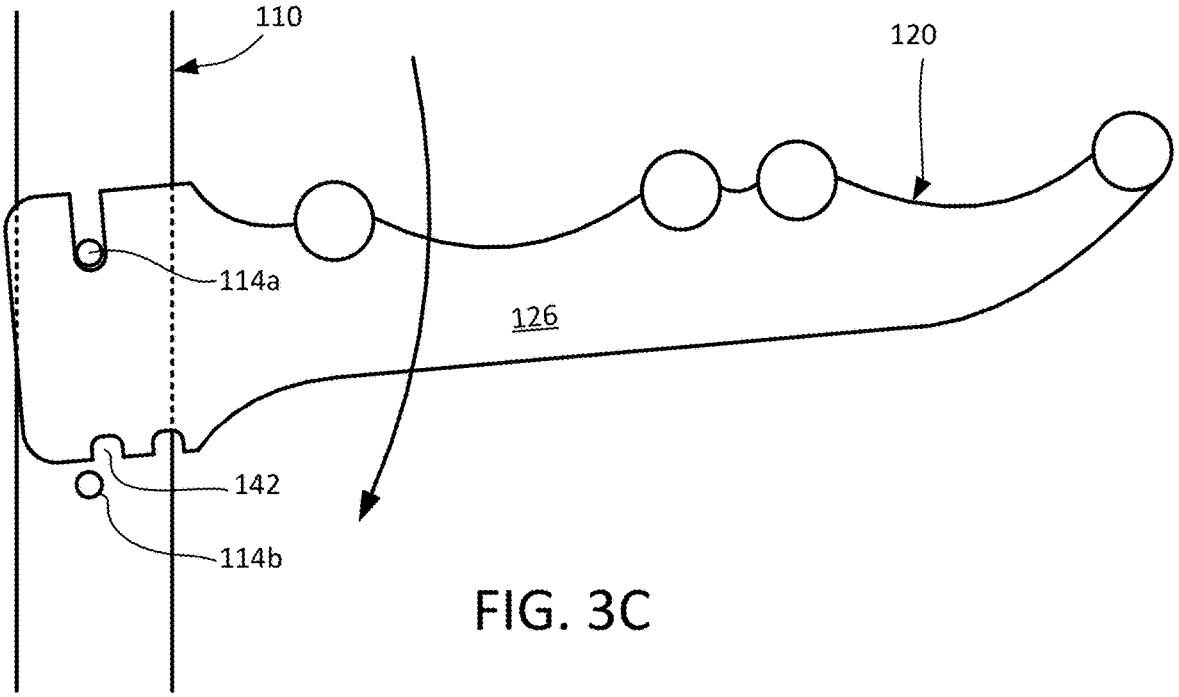
Figure 3D:
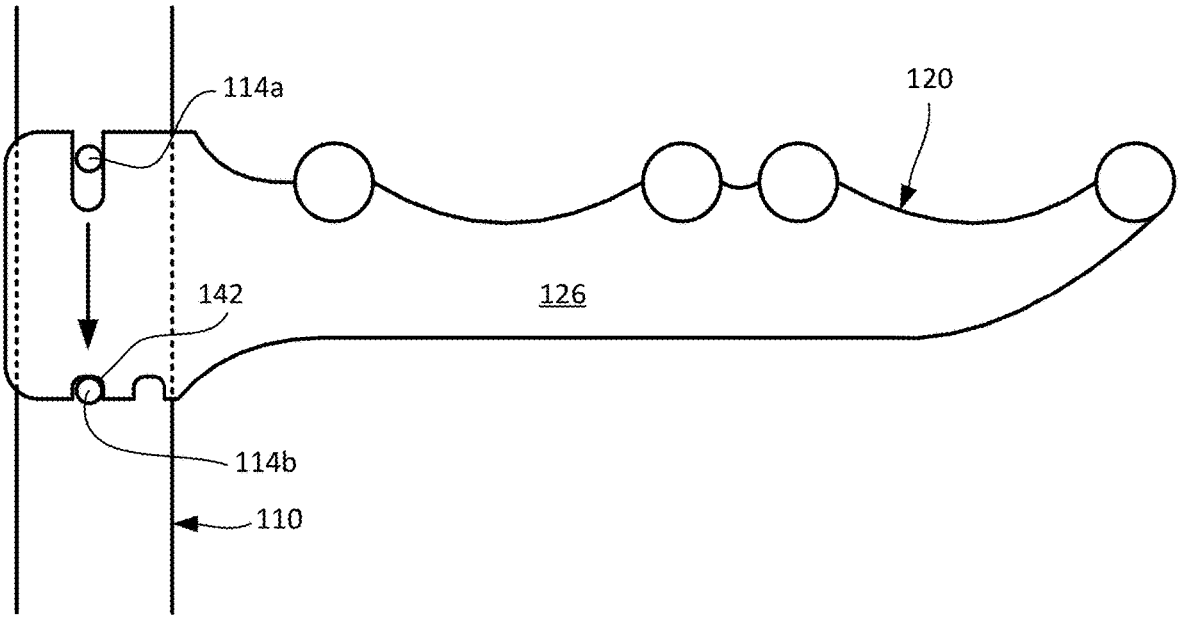
Figure 3E:
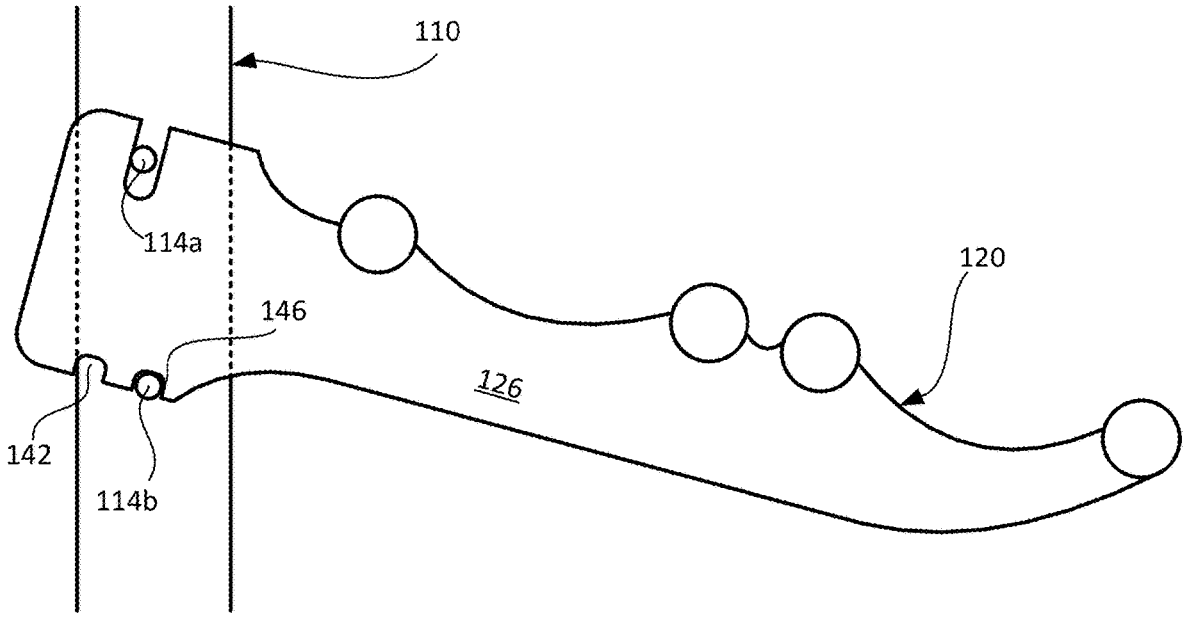
FIG. 3E illustrates attachment of the support arm to the standard in a second configuration.

As illustrated by FIGS. 1A and 3D, the bracket 120 may be held substantially perpendicular to the standard 110 when engaged with a pair of pins 114. To hold the bracket substantially perpendicular, the upper and lower recesses 132, 142 in the connection end of the bracket may vertically aligned in the body of the support arm. However, such perpendicular connection may limit the ability to view labels of wine bottles held by the bracket especially when the bottle holding bracket 120 is configured to hold two or more wine bottles. Accordingly, it may be desirable to offset the upper and lower recesses such that the bracket is tilted when connected to the standard. See, for example, FIGS. 1B. Alternatively, the bracket may be configured to connect to the bracket at two or more angular positions. Referring again to FIG. 2C, the bracket may include a second lower recess 146 extending into the lower edge 144 of the bracket 120. This second lower recess 146 may be spaced a predetermined distance from the first lower recess 142. In such an embodiment, after engaging the bracket with the upper pin 114*a*, the second pin 114*b* may be aligned with the second lower recess 146 and the bracket may be lowered until the second pin 114*b* is seated within the second lower recess 146. See FIG. 3E. In such an embodiment, the second lower recess may be positioned within the lower edge of the bracket such that the bottle holding bracket 120 extends from the standard 110 at a desired angle. By way of example, the bracket may be canted at a 15° degree angle. Such angular attachment of the bracket 120 may permit displaying the wine labels of two bottles held by the bracket. See, for example, FIG. 1B. Further, if an axis of the wine bottle is held aligned with a long axis of the bracket (not shown), a 15° degree angle may allow wine in the bottle to remain in contact with a cork of the bottle. Though discussed as having two lower recesses that allow for selecting first and second connection angles, it will be appreciated that the bottle holder bracket may include additional lower recesses to provide three or more connection positions. Further, the bottle holder bracket may include a single lower recess to connect the bracket at a non-perpendicular angle relative to the standard.

Figure 4A:
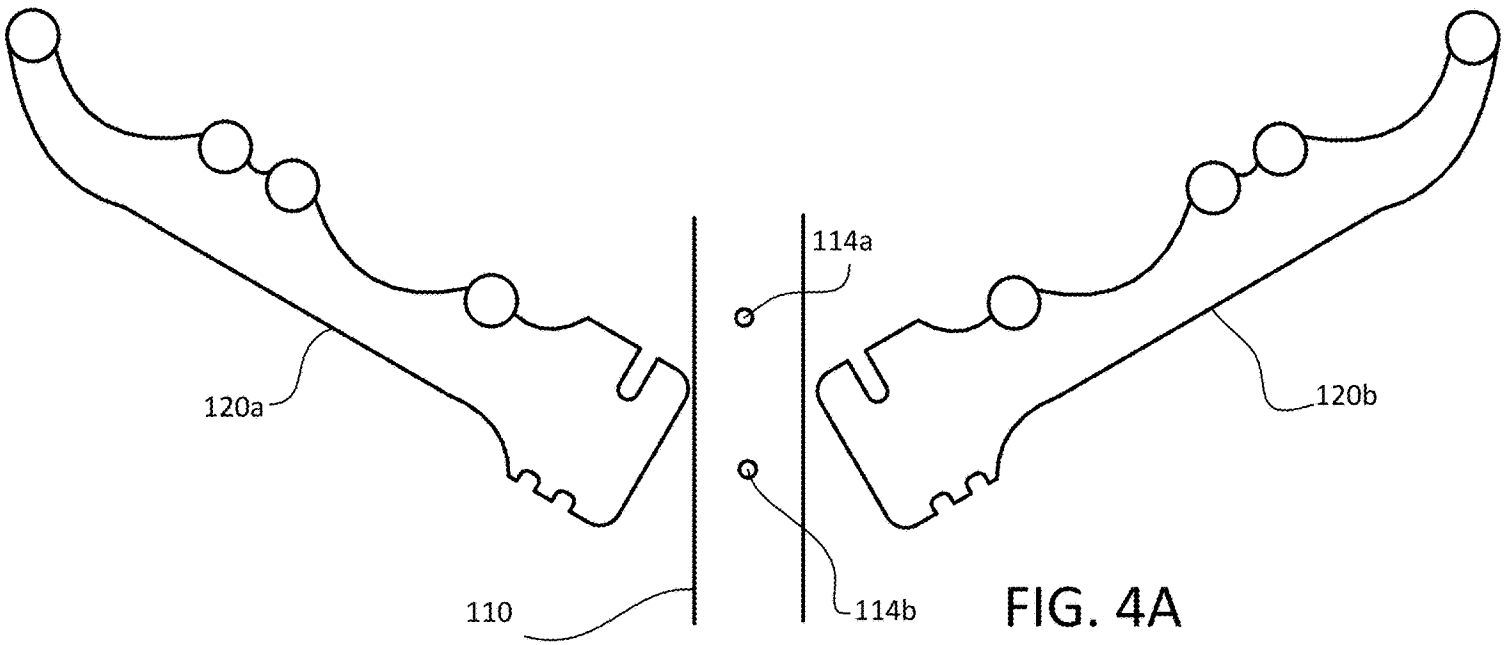
FIGS. 4A and 4B illustrate attachment of standard to opposing sides of a standard.
Figure 4B:
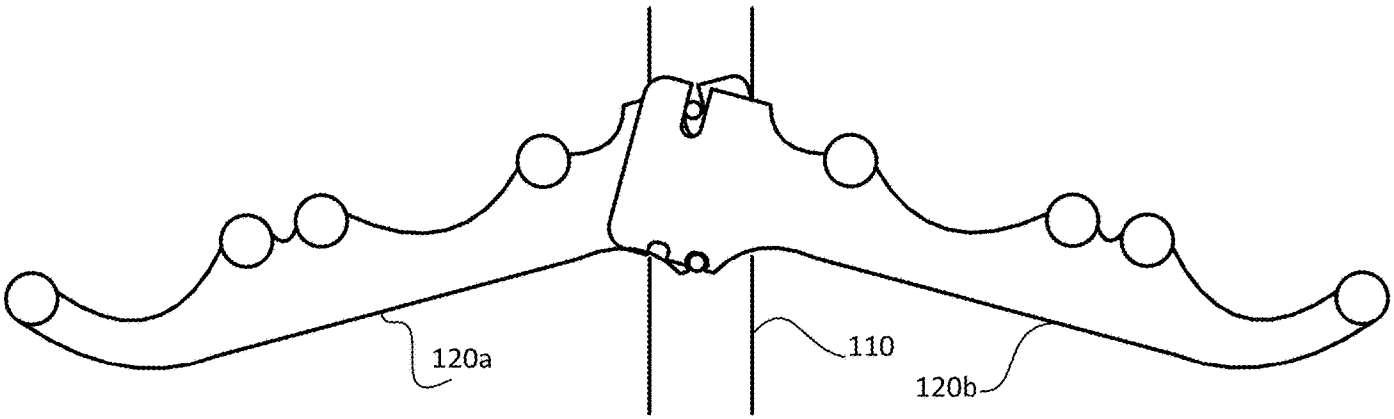

Numerous variations exist for the bottle holding bracket. As illustrated in FIGS. 4A and 4B, two brackets 120*a*, 120*b* may be configured to extend through and connect to a common pair of pins 114*a*, 114*b*. In such an arrangement, the connection ends of the brackets may be thinner to allow two backets 120*a*, 120*b* to fit between the upright strips of the standard 110. This allows holding bottles on either side of the standard 110.

Figure 5A:
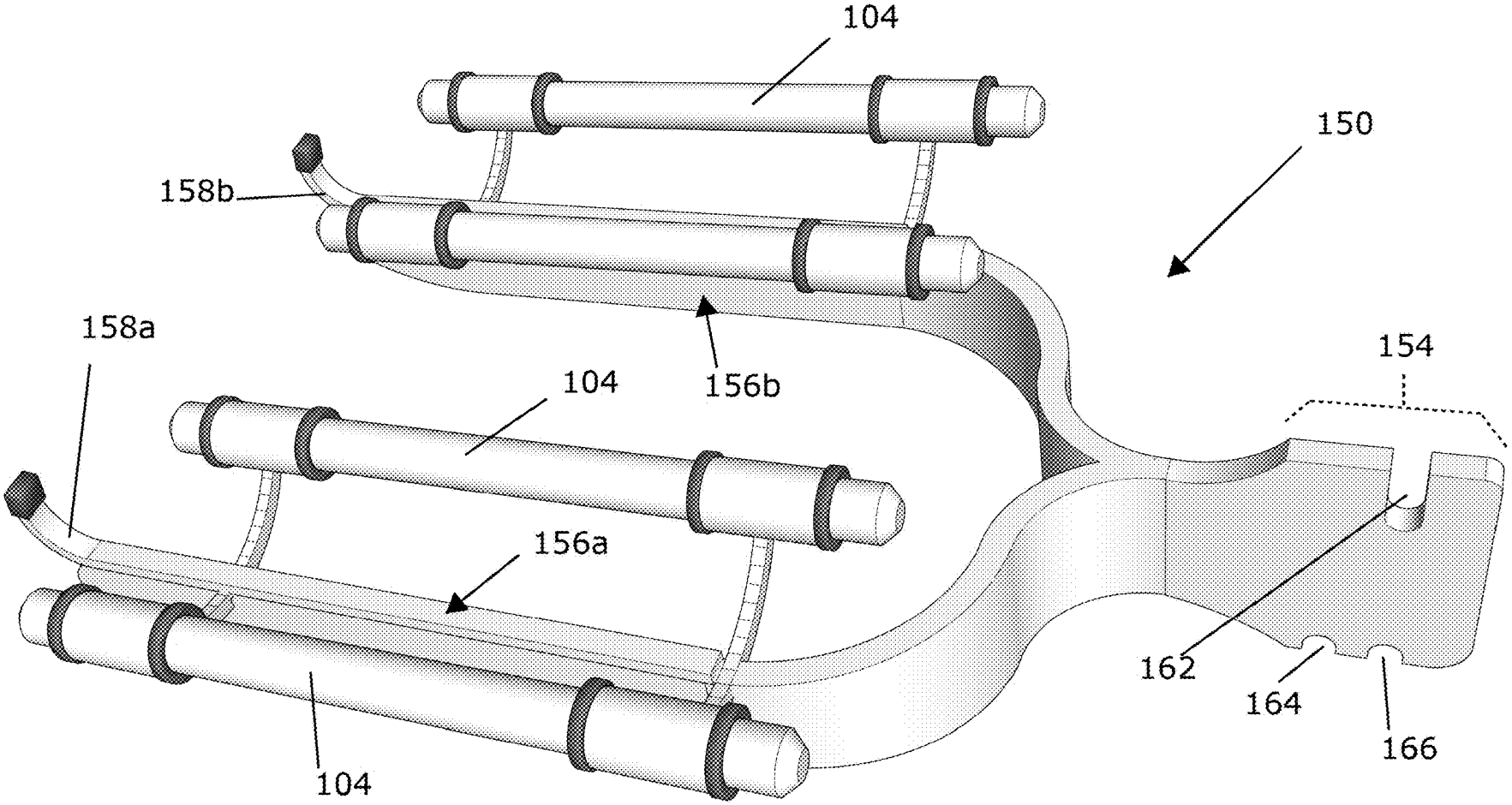
FIG. 5A illustrates another embodiment of a support arm.
Figure 5B:
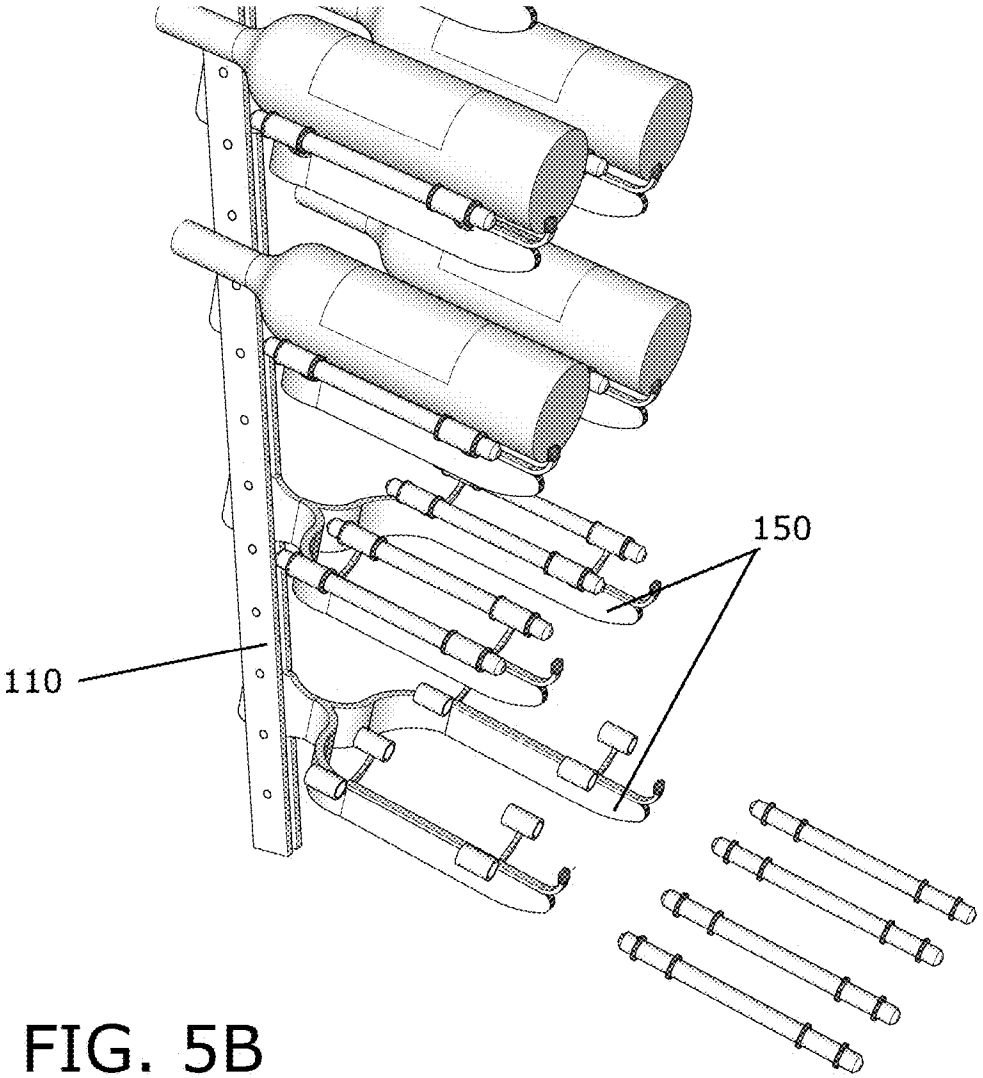
FIG. 5B illustrates the support arm of FIG. 5A attached to a standard.

In other embodiments, a cantilevered portion of the bottle holding bracket may hold a long axis of one or more wine bottles substantially parallel to a support arm of the bracket. FIG. 5A illustrates one embodiment of a bottle holding bracket 150 that is configured to hold two wine bottles parallel to first and second support arms 156*a*, 156*b* disposed in a wishbone configuration. The support arms each extend from a free cantilevered ends 158*a*, 158*b* to a common connection end 154. As illustrated, the connection end 154 includes an upper recess 162 formed in its upper edge and a first lower recess 164 and/or second recess 166 formed in its lower edge. As above, the bottle holding bracket 150 may utilize various ferrules and rods 104 to form bottle holders. Other bottle holding configurations are possible. The bottle holding backet 150 may attach to a standard 110 as discussed above. See FIG. 5B.

Figure 6:
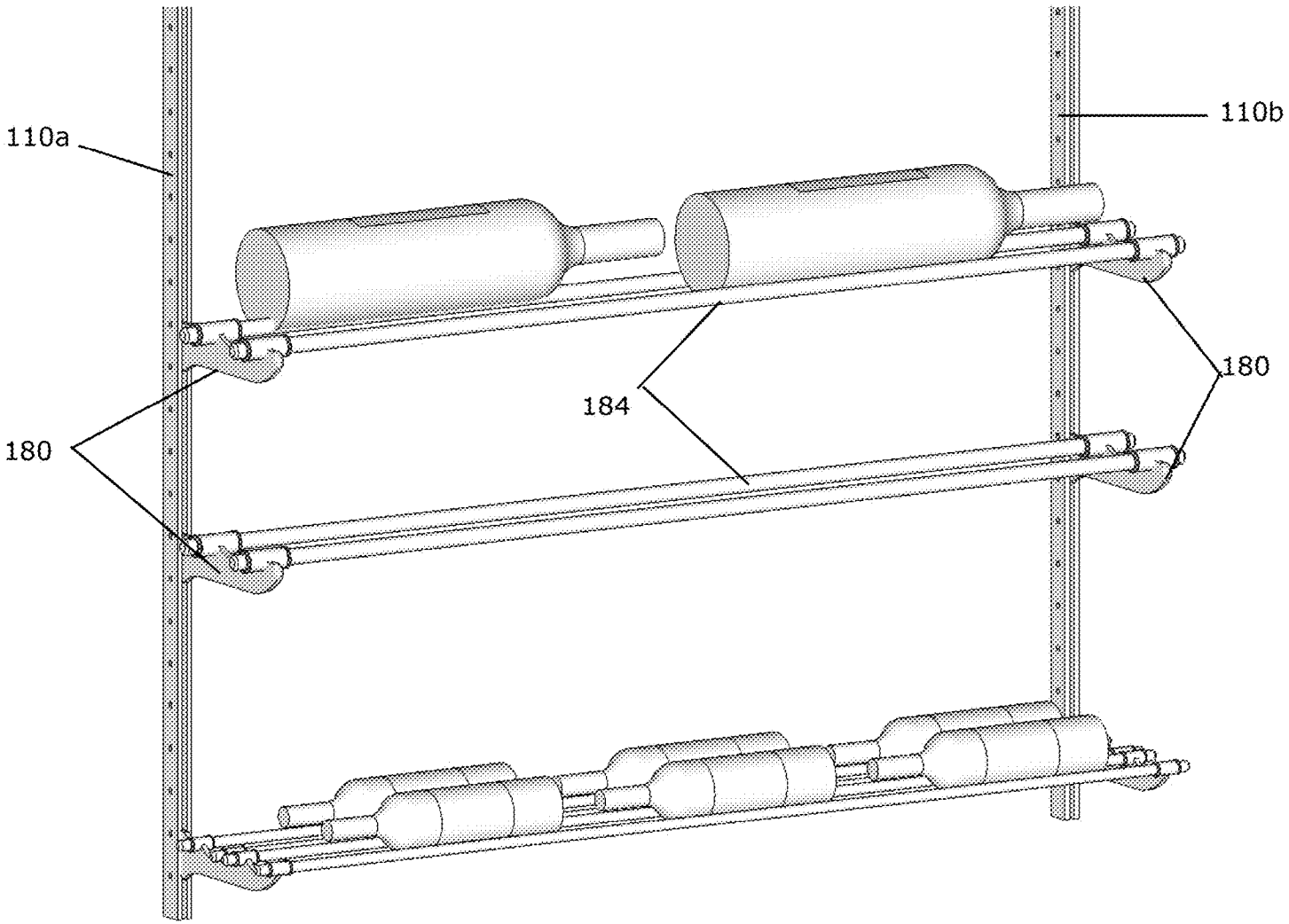
FIG. 6 illustrates another embodiment of a wine rack system.

In addition to utilizing a single standard to form a single wine rack, it will be appreciated that multiple standards may be utilized together to collectively form a wine rack. FIG. 6 illustrates an embodiment of a wine rack utilizing first and second standards 110*a*, 110*b* (hereafter 110 unless specifically referenced) to support various wine bottles. In the illustrated embodiment, each standard 110 may engage one or more bottle holding brackets 180. In the illustrated embodiment, the bottle holding brackets 180 may be configured to support rods 184 extending between the first and second standards 110*a*, 110*b*. As will be appreciated, multiple variations are possible.

The foregoing description of the wine rack design has been presented for purposes of illustration and description. Furthermore, the description is not intended to limit the invention to the form disclosed herein. Consequently, variations and modifications commensurate with the above teachings, and skill and knowledge of the relevant art, are within the scope of the invention. The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. A wine rack system, comprising:

a standard for vertical positioning; the standard having:

a first elongated strip, a second elongated strip spaced from and substantially parallel to the first elongated strip;

at least first and second pins extending between the first elongated strip and the second elongated strip, the first and second pins being spaced a first distance apart;

a support arm having a connecting end for attachment to the standard and a cantilevered end, the connecting end of the support arm having:

a width sized for receipt between the first and second elongated strips;

an upper recess formed in an upper edge, the upper recess sized to receive the first pin extending between first and second elongated strips, a first lower recess formed in a lower edge, the first lower recess sized to receive the second pin extending between the first and second elongated strips, wherein bottom ends of the upper recess and the first lower recess are spaced a second distance apart, wherein the second distance is less than the first distance; and a bottle holder attached to the support arm, the bottle holder being configured to support a wine bottle.

2. The system of claim 1, further comprising:

a second lower recess formed into the lower edge of the connecting end of the support arm and spaced from the first lower recess, the second lower recess sized to receive the second pin extending between the first and second elongated strips, wherein bottom ends of the upper recess and the second lower recess are spaced a third distance apart, wherein the third distance is less than the first distance.

3. The system of claim 2, wherein the support arm is held by the first and second pins substantially perpendicular to the standard when the first and second pins are disposed in the upper recess and the first lower recess.

4. The system of claim 2, wherein the support arm is held by the first and second pins at a predetermined angle relative to the standard when the first and second pins are disposed in the upper recess and the second lower recess.

5. The system of claim 4, wherein the predetermined angle is fifteen degrees.

6. The system of claim 1, wherein a depth of the upper recess relative to the upper edge of the connecting end of the support arm is greater than a depth of the lower recess relative to the lower edge of the connecting end of the support arm.

7. The system of claim 1, wherein the support arm comprises a plate having a constant width from the connection end to the cantilevered end.

8. The system of claim 1, wherein the bottle holder comprises:

a first pair of spaced rods disposed transverse to a body of the support arm extending between the connection end and the cantilevered end.

9. The system of claim 8, further comprising:

a second pair of spaced rods disposed transverse to the body of the support arm.

10. The system of claim 1, wherein, a body of the support arm attached to the connection end is a furcated body.

11. The system of claim 10, wherein branches of the furcated body at least partially define the bottle holder.

12. The system of claim 1, wherein the standard comprises:

a plurality of pins extending between the first elongated strip and the second elongated strip, each pin is spaced the first distance apart from adjacent pins.

13. The system of claim 12, wherein the support arm may be attached to the standard via any pair of adjacent pins.

14. The system of claim 12, further comprising:

at least first and second support arms, wherein each support arm is attached to the standard via a different pair of adjacent pins.

* * * * *